US010542847B2

(12) United States Patent
Luong et al.

(10) Patent No.: US 10,542,847 B2
(45) Date of Patent: Jan. 28, 2020

(54) PEDICURE CHAIRS AND PUMPS FOR USE WITH PEDICURE CHAIRS AND RELATED METHODS

(71) Applicant: Lexor, Inc., Westminster, CA (US)

(72) Inventors: Christopher L. Luong, Westminster, CA (US); Quang Nguyen, Irvine, CA (US); Thuong Pham, Long Hau commune (VN)

(73) Assignee: Lexor, Inc., Westminster, CA (US)

( * ) Notice: Subject to any disclaimer, the term of this patent is extended or adjusted under 35 U.S.C. 154(b) by 561 days.

(21) Appl. No.: 14/455,476

(22) Filed: Aug. 8, 2014

(65) Prior Publication Data

US 2015/0040310 A1 Feb. 12, 2015

Related U.S. Application Data

(60) Provisional application No. 61/863,827, filed on Aug. 8, 2013.

(51) Int. Cl.

| | |
|---|---|
| ***A47K 3/022*** | (2006.01) |
| ***A61H 35/00*** | (2006.01) |
| ***F24H 1/10*** | (2006.01) |

(52) U.S. Cl.

CPC ..... *A47K 3/022* (2013.01); *A61H 35/006* (2013.01); *F24H 1/103* (2013.01); *A61H 2201/0207* (2013.01); *A61H 2201/0228* (2013.01); *A61H 2203/0431* (2013.01)

(58) Field of Classification Search

CPC ..... A47K 3/022; A47C 1/04; A47C 15/004; A61H 35/006; A61H 2201/0207; A61H 2201/0228; A61H 2203/0431; F24H 1/103

USPC ..... 4/622

See application file for complete search history.

(56) References Cited

U.S. PATENT DOCUMENTS

| | | | | |
|---|---|---|---|---|
| 3,837,334 | A * | 9/1974 | Johnson | A61H 35/006 601/19 |
| 4,594,500 | A * | 6/1986 | Wright | F04D 29/5866 165/108 |
| 4,924,069 | A * | 5/1990 | Giordani | A61H 33/0087 392/485 |
| 5,172,754 | A * | 12/1992 | Graber | F28D 7/024 165/168 |
| 5,588,161 | A * | 12/1996 | Barradas | A47K 3/022 4/621 |
| 6,363,548 | B1 * | 4/2002 | Kuo | A47K 3/022 4/541.1 |
| 7,065,808 | B2 * | 6/2006 | Leung | A47K 3/022 4/622 |
| 8,245,718 | B2 * | 8/2012 | Busing | A47L 15/4225 134/108 |
| 8,989,566 | B2 * | 3/2015 | Liu | F04D 29/426 392/465 |

(Continued)

*Primary Examiner* — Erin Deery
*Assistant Examiner* — William R Klotz
(74) *Attorney, Agent, or Firm* — Klein, O'Neill & Singh, LLP

(57) ABSTRACT

A jet pump associated with a heat source, such as a heating element or heating coils, is disclosed. The heating element is located in a housing chamber and coaxially with an impeller. An electrical motor rotates the impeller and circulates water within the chamber and between coils of the heating element. The heated water is then discharged into a basin found in a pedicure chair or other devices requiring agitated, heated water.

26 Claims, 7 Drawing Sheets

(56) References Cited

U.S. PATENT DOCUMENTS

| | | | | |
|---|---|---|---|---|
| 9,297,553 | B2 * | 3/2016 | Vallejo Noriega | F04D 29/586 |
| 2007/0136944 | A1 * | 6/2007 | Long | A61H 35/006 4/622 |
| 2011/0004994 | A1 * | 1/2011 | Le | A61H 33/005 4/541.1 |

* cited by examiner

PEDICURE CHAIRS AND PUMPS FOR USE WITH PEDICURE CHAIRS AND RELATED METHODS

FIELD OF ART

The present disclosure is directed to apparatuses and methods for a pedicure chair with a basin and more particularly to pedicure chairs having water jet mechanisms and a jet pumps having a heat source for heating circulated water in the basin and related methods.

BACKGROUND

Certain types of pedicure chairs have a pipe system to introduce water into, and remove water from, the chair's basin. The water is circulated by a conventional motor-driven, shaft mounted, impeller. There is frequently water leakage around the shaft requiring maintenance. Also, the pipe system is subject to accumulation of dirt, mold and bacteria and is very difficult to clean and sterilize after use by customers. If not properly sanitized, there is the possibility of health concerns, safety and anxiety of customers.

A water circulation unit having a stator which creates a rotating magnetic field and is separated from the water by a magnetically permeable wall and a rotor on the opposite side of the wall is known in the art for circulating water. This unit is part of a hot water distribution system which circulates cooled down hot water away from a spigot and brings in hot water such that hot water is always immediately available at the spigot. However, once the hot water is introduced to the basin, this system lacks a temperature control or heating element to maintain the water temperature at a desired range.

SUMMARY

There is a need for a circulating system for water in a pedicure bath that provides temperature controlled heated water, adequate circulation of the water, that can be cleaned and sterilized rapidly and effectively, and combinations thereof.

In an exemplary embodiment, a pump sized and shaped for use with a basin of a pedicure chair is provided. The pump comprises a motor having a protruding drive shaft; a pump housing having an inner cavity and a first end connected to the motor. A heating source in the form of a heating element is disposed within the inner cavity of the pump housing and connected to the pump housing; said heating element defining an open space. An impeller is connected to the drive shaft and disposed, at least in part, within the inner cavity of the pump housing and the open space. The impeller is rotatable to circulate water. A cover is connected to a second end of the pump housing, the cover having at least one intake port and at least one outlet port. The cover can be connected to a mounting shoulder on the pump housing using removable or disengageable detents.

In one example, the heating element can be heating coils similar to heating coils found in a resistance heater. In other examples, the heating coils are heated by an external heating supply, such as heated air being routed through the heat coils. Thus, the heating element may more generically be referred to as a heating source that can heat water coming in contact with it from a first temperature and elevate the water to a second higher temperature.

The pump wherein the heat source can embody a spiral coil shape. The heat source may also be disposed, at least in part, outside of the pump housing.

The pump wherein the heat source can embody a longitudinal coil shape.

The pump wherein the heat source can further comprise a terminus, wherein the terminus is offset from the open space and projects, at least in part, through a base wall on the housing. In a particular example, the heat source has two termini that are each connected to wires for causing electrical current to pass through the heat source.

The pump can further comprise a first set of electrical wires connected to the motor and a second set of electrical wires connected to the heat source that are spaced from the first set of wires.

The pump wherein the impeller can circulate water within the inner cavity and around the heat source to produce heated water.

The pump can further comprise a basin wall surface located between an adjustable mounting flange and a mounting shoulder on the pump housing.

A further aspect of the present device and system is a pedicure chair with water circulation. In an example, the pedicure chair can comprise a basin comprising an exterior surface and an interior surface for holding water and at least one pump coupled to the basin. In an example, the pump comprising a motor having a protruding drive shaft, a pump housing having an inner cavity and a first end connected to the motor. A heat source is disposed within the inner cavity and connected to the housing. Said heat source can comprise an open space. An impeller is connected to the drive shaft for circulating water in the basin. The impeller is disposed, at least in part, within the inner cavity of the pump housing and the open space. A cover is connected to a second end of the housing, the cover having at least one intake port and at least one outlet port. Wherein the motor is disposed on the exterior surface of the basin and the cover is disposed on the interior surface of the basin.

The pedicure chair wherein the heat source can embody a spiral coil shape.

The pedicure chair wherein the heat source can embody a longitudinal coil shape.

The pedicure chair wherein the heat source can further comprise a terminus, wherein the terminus is offset from the open space and projects, at least in part, through a base wall on the housing.

The pedicure chair can further comprise a first set of electrical wires connected to the motor and a second set of electrical wires connected to the heat source.

The pedicure chair wherein the impeller can circulate water within the inner cavity and around the heat source to produce heated water.

The pedicure chair wherein the heated water can discharge from the pump via the at least one outlet port.

The pedicure chair can further comprise a temperature control system comprising a temperature selector and a controller, wherein the controller is connected to the heat source.

The pedicure chair wherein the temperature control system can further comprises a display disposed on the chair for displaying water temperature in the basin.

A still further aspect of the present disclosure is a method for circulating heated water in a basin of a pedicure chair. The method can comprise the steps of attaching a pump to the basin, the pump comprising at least one intake port, at least one outlet port, and a chamber and disposing an impeller and a heat source in the chamber. The method can further comprise the steps of providing electrical current to the heat source and rotating the impeller to draw water from the basin into the chamber via the at least one intake port.

The method can still comprise the steps of circulating the water in the chamber, transferring heat from the heat source to the water, and discharging heated water from the chamber to the basin via the at least one outlet port.

The method can further comprise the step of isolating the motor from the chamber such that water is prevented from entering the motor.

The method can further comprise the step of altering the electrical current to the heat source to change the temperature of the water in the basin.

The method can further comprise the step of circulating water between coils of the heat source to affect the heat transfer.

BRIEF DESCRIPTION OF THE DRAWINGS

These and other features and advantages of the present device, system, and method will become appreciated as the same become better understood with reference to the specification, claims and appended drawings wherein:

DETAILED DESCRIPTION

Figure 1:
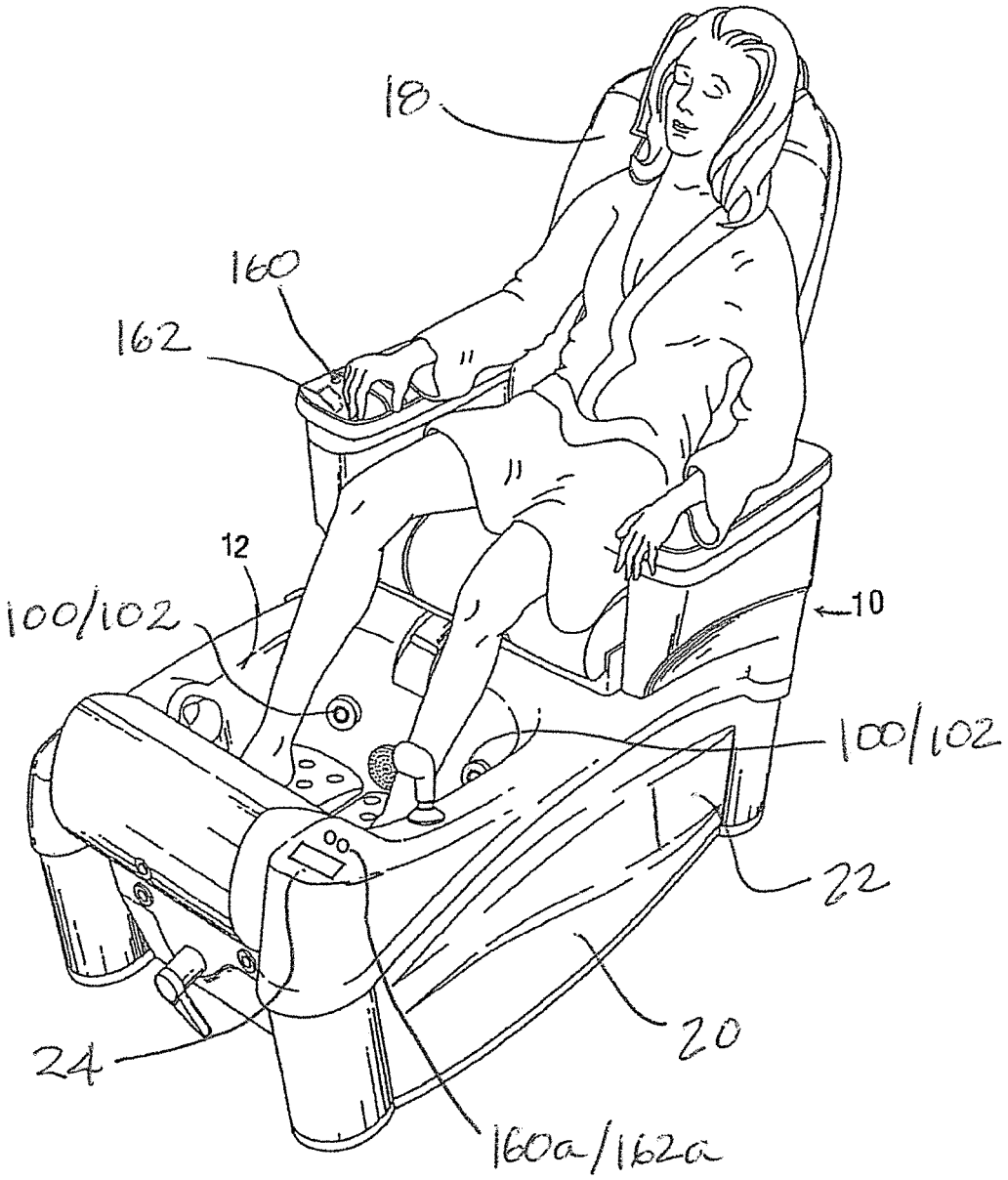
FIG. 1 illustrates a perspective view of a pedicure chair with pumps having a heating source according to one embodiment of the present disclosure.

The detailed description set forth below in connection with the appended drawings is intended as a description of the presently preferred embodiments of pedicure chairs and circulating pumps for use with pedicure chairs provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like reference numerals are intended to indicate like or similar elements or features.

Referring now to FIG. 1, a pedicure chair 10 comprising a basin 12 for holding a water bath is shown with a user seated on a seat 18. The basin is sized and shaped to receive and bathe the person's feet. Water is circulated in the basin 12 by one or more circulating pumps 100 located behind the chair cover 20 and out through covers or nozzles 102 that may be adjustable to direct the flow of water, such as at the person's feet. Two covers 102 are visible in FIG. 1. In some examples, one or more removable panels 22 are provided with the chair housing to provide access to the one or more circulating pumps 100 disposed behind the basin 12, such as for maintenance and repairs. In some examples, circulating pumps with a heating element or source may be used with the chair 10 without or in combination with circulating pumps without heating elements. The circulating pumps associated with a heating source allows the water inside the basin to be heated and maintained at a desired temperature range to provide the user with a better experience than chairs without a similar heating source. The heating source can heat water coming in contact with it from a first temperature and elevate the water to a second higher temperature. In some examples, the heat source can be heated gas or air circulated in through the pump for contacting with the water.

As shown, the chair 10 includes a temperature selector 160 and a display 162 for monitoring the temperature of the water in the basin 12. Other switches or control mechanisms may be included, such as an on/off button and switches for controlling other functions incorporated with the chair. The temperature selector 160 may be a simple potentiometer for raising or lowering water temperature or may be a more complicated controller that allows programming and automated adjustments of water temperature. The display 162 may be selectable to display various parameters such as actual water temperature, desired water temperature, elapsed time that the person has immersed their feet in the basin 12, total time, or other parameters. In another example, a second control and display panel 24 is provided nearer the basin 12 to permit the technician or worker to control the water temperature and other parameters. The second control and display panel 24 may include a temperature selector 160*a*, a display 162*a*, an on/off switch, and an emergency override, as non-limiting examples.

A predetermined amount of water can be placed in the basin 12 and the water circulated within the basin by the one or more circulating pumps 100. The water can be heated to the desired temperature by means of the temperature selector 160, which can increase or decrease heat input from a heating source that the circulated water comes in contact with to thereby control the water temperature. Additional substances such as conditioners, medicaments, fragrances, etc., may be placed in the basin with the heated water for a holistic experience. A customer seated in the pedicure chair 10 with her feet submerged in the circulating heated water may adjust the water temperature accordingly by the temperature selector 160. The basin 12 can be emptied of water using existing means after the pedicure procedure is completed and the customer exits the chair 10. Then, the basin 12 and portions of the jet pump 100 that come in contact with the heated water can be sanitized in preparation for the next customer. For example, a new bath with a cleaner or disinfectant may be circulated through the basin to sanitize the chair for the next customer.

Figure 2:
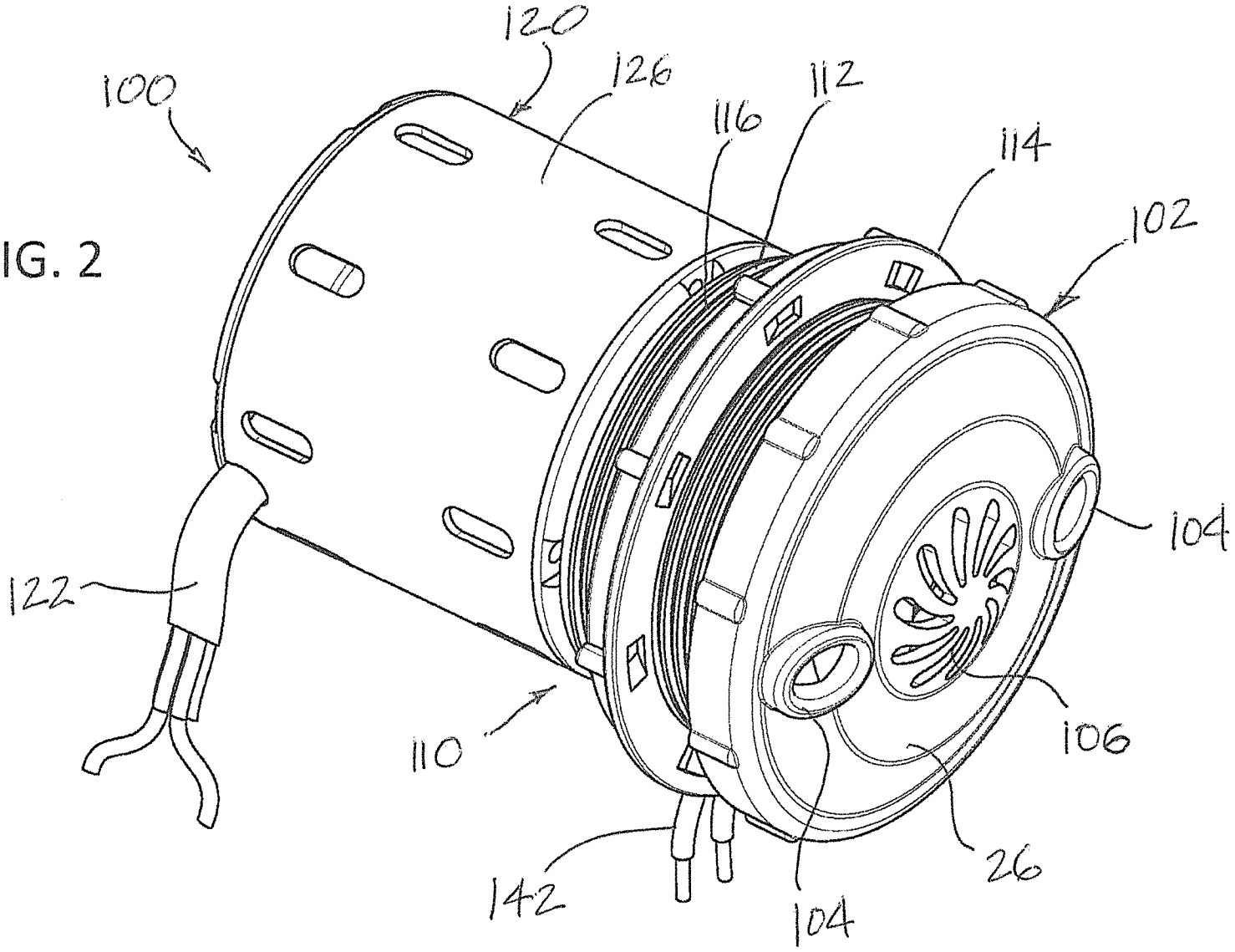
FIG. 2 illustrates a perspective view of one of the pumps of FIG. 1 according to one embodiment of the present disclosure.
Figure 2A:
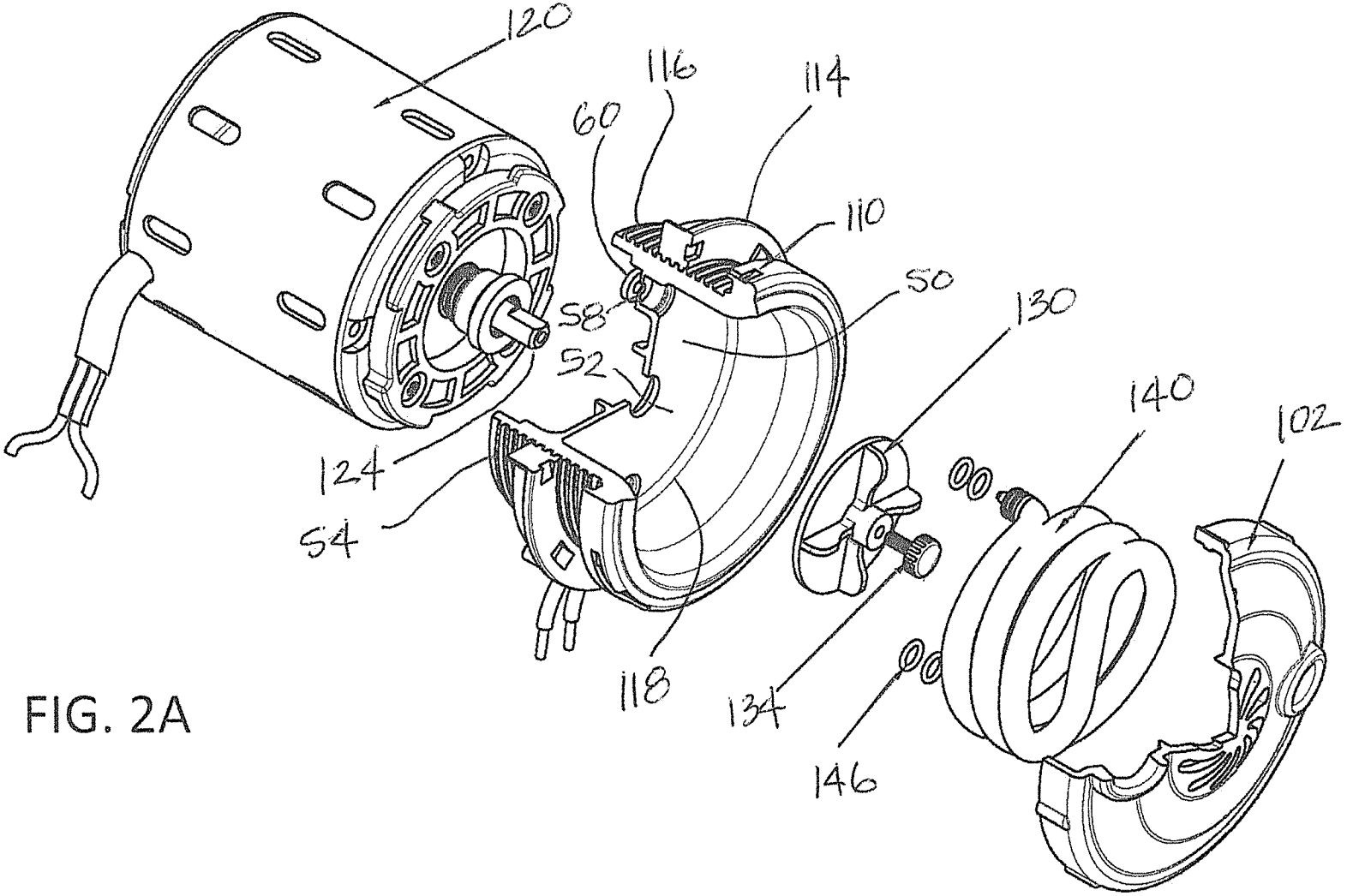
FIG. 2A illustrates a perspective exploded view of various pump components.

An exemplary circulating pump with a heat source, such as a heating element 100, is illustrated in FIG. 2 and FIG. 2A. A pump housing 110 having a generally cylindrical shape having external threads 112 formed thereon is shown. The pump housing 110 may be formed with two separate housing elements or components and is connected to the motor casing 126 to form an exemplary pump provided in accordance with aspects of the present device, system and method. A first or outer housing element 114 of the pump housing 110 is threadedly or rotatably coupled to the elongated end 54 of the second or inner housing element 116. The axial position of the first housing element 114 may be adjusted relative to the second housing element 116 by rotating the two components relative to one another. Assembly bolts (not shown) may be used to bolt the first housing element 114 to the mounting bracket 56 mounted to the motor casing 126 to connect the pump housing 110 to the motor casing 126. Alternatively, the first housing element 114 may attached to the mounting bracket 56 on the motor casing using reversible detents. In accordance with aspects of the present device, system and method, the second housing element 116 has an integrally formed mounting shoulder 105, which may instead be separately formed and subsequently coupled to the cylindrical section 54 of the second housing element. The gap between the first housing element 114, which may be referred to as an adjustable mounting flange, and the mounting shoulder 105 may be adjustable to receive different wall thicknesses therebetween, such as different basin wall thicknesses. Internally, the second housing component 116 has an integrally formed base wall 50 having a shaft opening 52 for receiving the drive shaft 124. The base wall 50 is preferably integrally formed with the threaded cylindrical section 54, such as by casting or molding depending on the material used to form the pump housing 110. In another embodiment, the base wall 50 is separately formed at subsequently attached to the cylindrical section 54.

The pump housing 110 may be installed to the basin 12 by placing the second housing element 116 through an opening in the basin 12 and then tightening the first housing element 114 towards the mounting shoulder 105 with the wall surface of the basin 12 located therebetween. The cover 102 can then engage the mounting shoulder 105, such as by engaging removable detents on the cover and on the mounting shoulder 105 of the housing, to cover the internal pump components, such as the impeller and heating coils, as further discussed below. Internally, where the drive shaft 124 of the motor rotates and connects to an impeller, a stuffing box equipped with packing materials or a mechanical seal is provided to seal against water leakage via the shaft and into the motor working components, such as to the rotor and stator.

The cover 102 has one or more intake ports or inlet openings 106, herein inlet or intake port, and one or more outlet ports 104, herein outlet or outlet port. In general, water from the basin 12 enters the circulating pump 100 via the intake port 106, is circulated within the housing 110, such as in the volute section of the housing by an impeller, and exits the circulating pump 100 via the outlet port 104. In some examples, the outlet port 104 is pivotable or maneuverable, such as with a ball and socket joint, relative to the cover surface 26 to allow directional control of the outlet from the pump.

Figure 3:
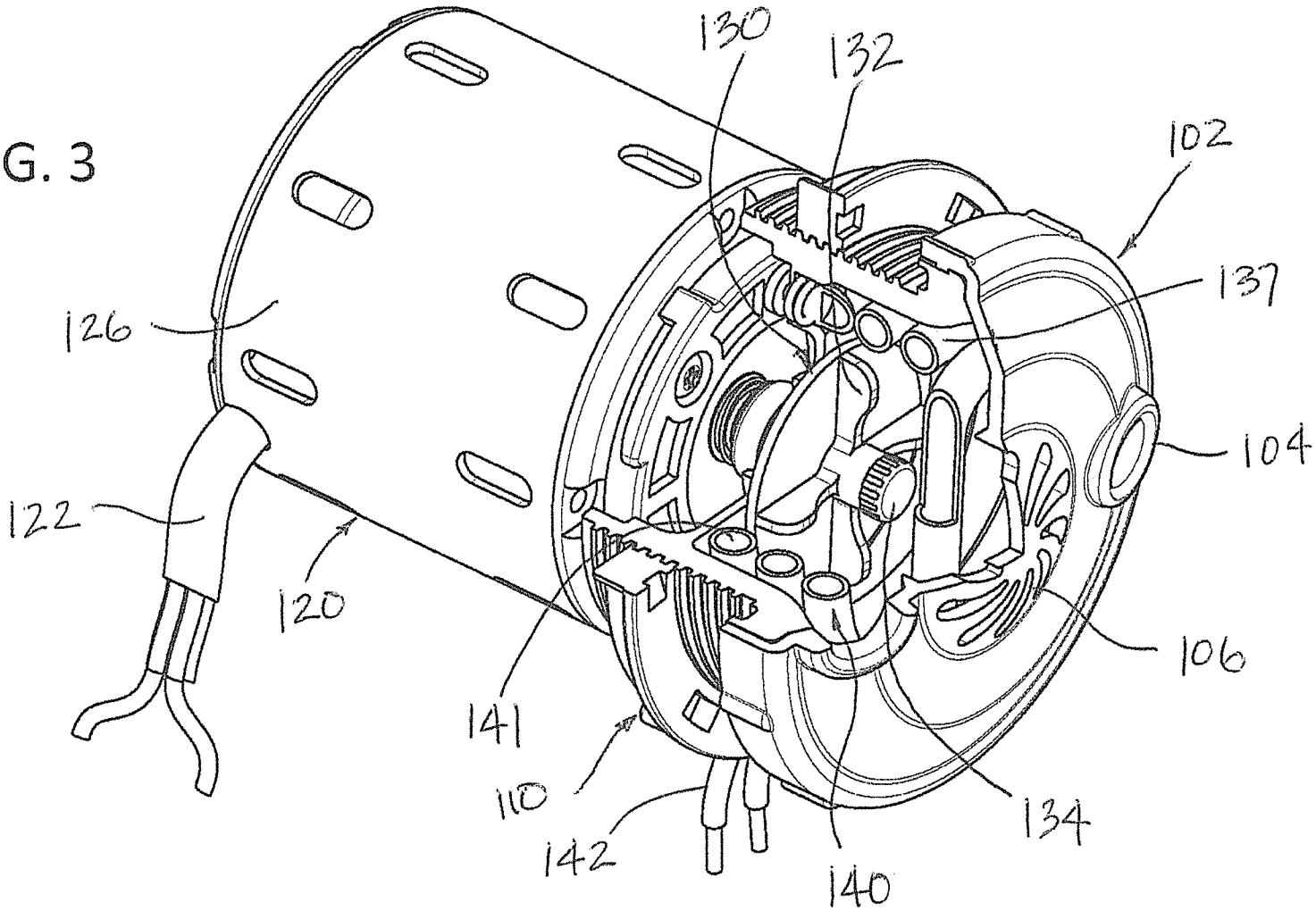
FIG. 3 illustrates a partial cut away perspective view of the pump of FIG. 2 according to one embodiment of the present disclosure.
Figure 4:
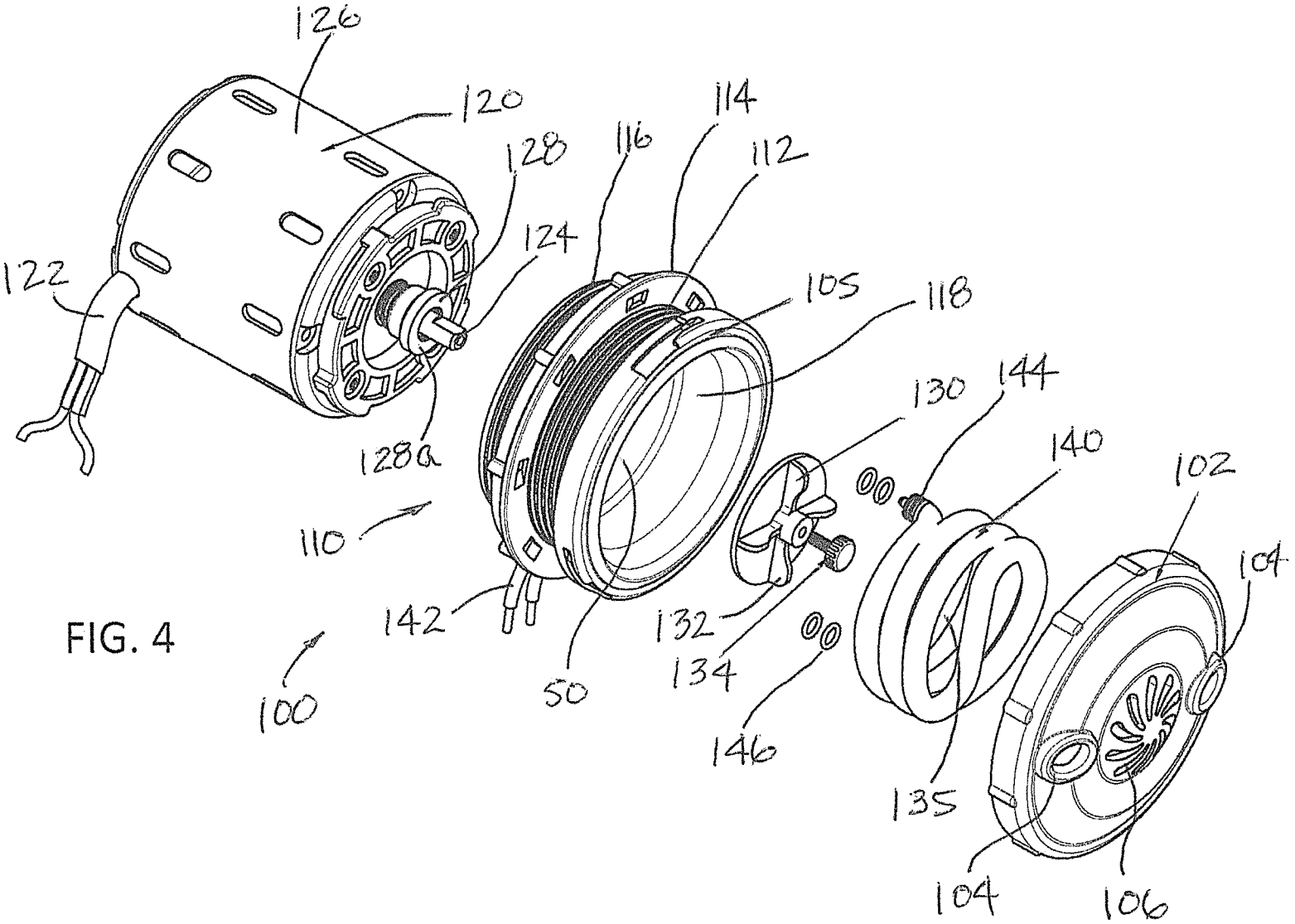
FIG. 4 illustrates an exploded view of various components of the pump of FIGS. 2 and 3 according to one embodiment of the present disclosure.

A single phase synchronous motor 120 is illustrated in FIG. 3. This motor 120 is connected to electrical wiring 122, which is configured to be connected to a power source when mounted to the chair 10, such as an AC electrical outlet or to a power supply contained within the chair 10 (not shown). With reference to FIG. 4 in addition to FIGS. 2A and 3, the motor 120 has a drive shaft 124 that protrudes from a motor casing 126 through a shaft opening 52 on the base wall 50 of the pump housing 110 and into an inner volume of the pump housing 110, i.e. the housing cavity 118. An impeller 130 is coupled at a distal end of the drive shaft 124 to be rotated by the shaft. The cylindrical shaft 124 has a flat mounting surface to align with a corresponding shaped bore on the impeller 130. The impeller 130 is slid onto the shaft and is secured thereto by a lock bolt 134, which has an enlarged gripable head to facilitate removing and tightening of the lock bolt. The lock bolt 134 has a threaded male stem or other type of friction, snap lock, or twist lock features for securing to the drive shaft 124. The impeller 130 is manually removable from the drive shaft 124 for cleaning and/or replacement. The impeller 130 has a plurality of vanes 132 formed on a first or outward facing surface. The impeller 130 has an open face with exposed vanes 132. In another example, the impeller is a closed face impeller.

In an alternative embodiment, the electric motor 120 may be an induction motor that has an electrically activated stator and a permanent magnet rotor. In a preferred embodiment, the stator has a well formed therein, the opening of the well being oriented toward the basin 12. The rotor has a semi-spherical shape which is received in the well in the stator. The rotor may have a central bore thereon and the well may have a post formed centrally therein such that the rotor is always properly seated in the well. The rotor preferably has a plurality of vanes formed circumferentially therein.

Also illustrated in the cut away region of FIG. 3 are portions of heating element 140. In the present embodiment, the heating element 140 embodies a continuous spiral shaped coil forming or defining an open section or space 135 inwardly of the coil. The impeller 130 is positioned within the open space 135 of the heating element 140. As shown, the continuous spiral shaped coil has a hollow core 141. In another example, the heating element has a solid core. The continuous coil defines a combined surface area 137 for heating the water. The combined surface area 137 may be located completely within the pump housing for heating water drawn into the pump housing by the impeller. The continuous coil 140 may also be viewed as multiple coils connected end to end to form a single heating continuous element. The heating element 140 is disposed in the housing cavity 118. The impeller 130 is disposed within the open section 125 of the heating element 140. Thus, the impeller 130 is positioned inside an open space 135 of the heating element 140, which is positioned inside the housing cavity 118 of the pump housing 110. Coupled to the heating element 140 are electrical wires 142 for energizing and heating the coil. Similar to the motor electrical wiring 122, the heating element electrical wiring 142 is configured to connect to a power source, such as an AC electrical outlet or to a power supply contained within the chair 10.

When operational, the motor 120 turns the impeller 130 to create a vacuum at the inlet to draw in water. The motor can turn in either a clockwise or counter clockwise manner. Water within the basin 12 is drawn into the intake opening 106 located generally in the center of the circulating pump cover 102 by rotation of the impeller 130. The vanes 132 on the impeller 130 circulate the water radially and outward within the housing cavity 108 and towards the heating element 140. The circulating water contacts the heating element 140 which results in a heat transfer from the heating element 140 to the water. The heated water is then discharged axially through the plurality of outlet ports 104. When discharging, the outlet ports 104 act as a nozzle to forcefully direct the water into the basin 12 producing agitation, circulation, and a whirlpool effect of the water within the basin 12.

Thus, an aspect of the present disclosure may be understood to include device, system, and method comprising a pump sized and shaped for use with a pedicure chair, such as for mounting to a wall surface of a basin of the pedicure chair. Another aspect of the present disclosure is a combination pedicure chair comprising a basin having a pump mounted thereto. In an example, the pump 100 has a motor and a drive shaft 124 projecting at least partially through a pump housing 110. The pump housing 110 has an elongated body and is connected, such as fastened, to the motor. The pump housing defines a housing cavity for receiving an impeller, which is mounted to the drive shaft. The impeller is removably connected to the shaft, such as with a threaded fastener. The impeller is configured to draw in liquid or water into the pump housing to heat the water. In an example, a heat source is positioned in-line with the pump for heating the water. In another example, the heat source is located externally of the pump and discharge water from the pump is routed through the externally located heat source before entering the basin. In one example, a continuous heating coil is positioned inside the pump housing for heating water drawn into the pump. When mounted inside the pump housing, the heating coil has an open section 135 for accommodating the impeller 130. Said differently, the impeller can be located centrally of the heating coil for heating the water. The impeller can be recessed from the outer-most coil section of the heating coil. In another example, the impeller is located axially evenly with the outer-most coil section. The heating coil can be solid or hollow.

A further aspect of the present disclosure is understood to include a pump sized and shaped for use with a pedicure chair comprising a plurality of heating coils mounted in a pump housing and having an impeller located centrally of the plurality of heating coils. The pump comprises one or more inlet openings 106 located radially internally on a pump cover 102 from one or more outlet ports 104. A plurality of vanes on the impeller is configured to draw water through the one or more inlet openings 106, agitating or circulating the water across the combined surface area 137 of the heating coils for heating the water. In some examples, the pump housing is sectioned to form a volute for working with a cover having a discharge nozzle located radially inwardly of one or more inlet ports. In another example, some or all of the combined surface area of the heating coils may be located outside of the pump housing and water is either drawn into the pump housing through the externally located coil sections or is discharged from the pump and out through tubing or piping sections and through the externally located coil sections and into the basin. In one exemplary embodiment, the plurality of coils are made from a thin wall metal tubing length rolled or coiled into a continuous loop having two or more coils axially positioned relative to one another. A heating wire is positioned inside the tubing length before the length is coiled. The gap between the tubing length and the wire can be insulated, such as with magnesium oxide insulation (MGO). The two ends of the coiled section are then crimped and optionally sealed. The heating wire, which can be made from nichrome wire, is exposed at the two sealed ends and connected to wires to form a resistance heater. In some examples, the continuous coil can be made from stainless steel, from copper tubing, or their alloys.

A further aspect of the present disclosure is a method for heating water in a pedicure chair. In one example, the method comprises attaching a pump to a basin of the pedicure chair. The method further comprises drawing water from the basin in through an inlet of the pump and circulating the water across a heat source then discharging the heated water out an outlet. The method can further comprise circulating the now heated water through the pump with the heat source until the water reaches a desired temperature. In an example, the heat source comprises a heating coil located in a volute section of the pump. In another example, the heat source is located externally of the pump. The heat source can be a resistance heater. In a particular example, the heat source comprises a continuous coil located within a pump housing and having a central open area for accommodating an impeller. In a stiff further example, the method comprises the step of integrating a controller for controlling the heat input to the heat source. A control switch may be provided on the chair to allow the user and/or the worker to adjust the control settings for controlling the water temperature in the basin.

The various components of the circulating pump 100 are illustrated in FIG. 4, which shows the pump in an exploded view. The motor 120 has electrical wiring 122, a protruding drive shaft 124 and a casing 126. There may be various seals 128 or stuffing material circumscribing the drive shaft 124 to prevent water from entering inner portions of the motor 120. As shown, the seal is a mechanical seal. The pump housing 110 is attached to the motor casing 126 through a variety of different means, such as screws, bolts, fasteners, detents or combinations thereof. In other embodiments, the outer threads 112 of the pump housing 110 may be mated with threads on the motor casing 126 to connect the two together. In other examples, a snap lock or twist lock mechanism is used to secure the casing motor 120 to the pump housing 110 or vice versa.

As previously discussed, the shaft opening 52 is provided on the base wall 50 of the pump housing 110 for receiving the drive shaft 124 (FIG. 2A). The base wall 50 has a mating mechanical seal element with a seal face mounted on the opposite wall for mating contact with the spring end 128*a* of the mechanical seal (FIG. 4). The pump housing 110 with the base wall 50 may be formed from two or more components that are assembled together. Two mounting bores 58 are provided on the base wall 50 for receiving the termini on the heating element 140. A washer or locking ring 60 is provided at each mounting bore 58 for engaging a respective terminus 144 on the heating element. The heating element 140 may be attached to the base wall 50 on the pump housing 110 via the two heating element termini 144 (only one terminus 144 is shown) projecting through the two corresponding mounting bores 58 on the base wall 50 of the pump housing. O-rings 146 or gaskets may be provided with the mounting bores 58 for forming a seal between each terminus and corresponding mounting bore 58. The two termini 144 should be positioned such that they do not to interfere with the rotation of the impeller 130. Electrical wiring 142 is connected to the heating element terminus 144. The connection of the electrical wiring 142 to the heating element terminus 144 is sealed by a rubber gasket or other water resistant means to prevent water corrosion of the terminus 144. The drive shaft 124 and impeller 130 extend coaxially into the central opening 135 of the spiral shaped heating element 140. In some examples, the heating element 140 has fins formed on the surface thereof to increase the surface area of the coil for more efficient heat transfer with the water circulated thereacross.

In one example, the heating element 140 is formed from ceramic insulated metal, i.e. an outer surface of ceramic or alumina that coats, covers or encapsulates an inner metallic conductive material. The inner conductive material may be Nichrorne 80/20 (80% nickel, 20% chromium) which has an inherently high resistance. The ceramic or alumina coating protects the heating element 140 from corrosion and/or oxidation. Other heating elements may be formed from refractory ceramics such as molybdenum disilicide or molybdenum disilicide doped with aluminum.

The circulating pump cover 102 is attached to the mounting shoulder 105 of the second housing element 116. In one example, the mounting shoulder 105 has two or more grooves for receiving projections formed on the cover 102 in a removable detent engagement. A chamber within the housing cavity 118 is provided, which may also be referred to as the volute. The drive shaft 124, impeller 130 and heating element 140 are disposed within the chamber. The chamber provides at least two functions. First, it facilitates the impeller 130 drawing water from the basin 12 into the chamber via the intake ports 106 and discharging the water via the outlet ports 104 at high velocity to produce a jet-like effect for the discharged water thereby agitating the water in the basin 12. Second, the chamber allows for the circulation of water around the heating element 140 to facilitate the heat transfer between the heating element 140 and water providing for heated water in the basin 12. In other examples, the impeller with chamber draws in water and agitate the water but does not heat the water. The heating function may be provided by an externally mounted heat box having a heat source located therein. The heat box and the pump may piped together to force water to flow their across for heating. Alternatively, the heat box may have a plurality of openings thus allowing agitated water in the basin to naturally flow there into to be heated.

Figure 5:
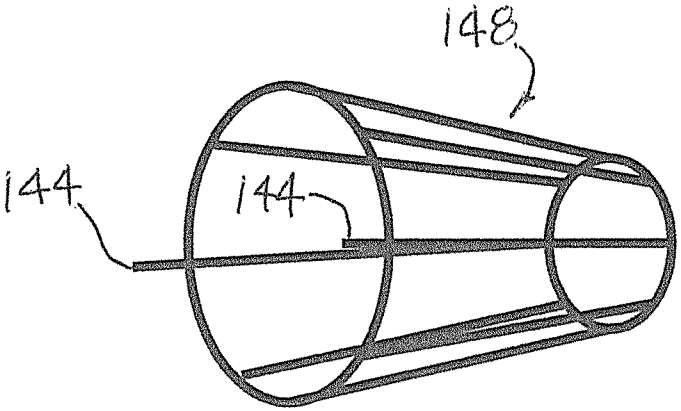
FIG. 5 illustrates a perspective view of a heat source according to an alternative embodiment of the present disclosure.

An alternative configuration of the heating element is illustrated in FIG. 5. In this embodiment the heating element is arranged in a continuous longitudinal serpentine coil 148. That is, the coil 148 is arranged generally longitudinally and parallel to the drive shaft 124. There are longitudinal gaps in the coil 148 to enable water to circulate radially outward. The placement of the drive shaft 124 and impeller 130 is similar to the embodiment of FIG. 4, i.e. within the central opening 135 of the coils. The heating element termini 144 are again positioned such that they permit, i.e., do not obstruct, free rotation of the drive shaft 124 and impeller 130. The longitudinal arrangement of the heating element 148 in the alternative embodiment may provide for a marginally lengthier circulating pump 100 than the embodiment shown in FIGS. 1-4. However, the longitudinal arrangement may provide for a circulating pump 100 that has a smaller circumference throughout the various components, i.e. housing 110, motor 120, heating element 148 and circulating pump cover 102 as compared to the previous embodiment. The heating element 148 may be formed of similar materials as heating element 140. In still yet another example, a separate housing comprising a heating element may be mounted directly to the basin and spaced from the pump, called a heating box. The heating box can be located before the inlet to the pump or after the pump discharge so that water drawn into the pump or discharged out the pump come in contact with the heating box to be heated by the heating element located inside the heating box.

Figure 6:
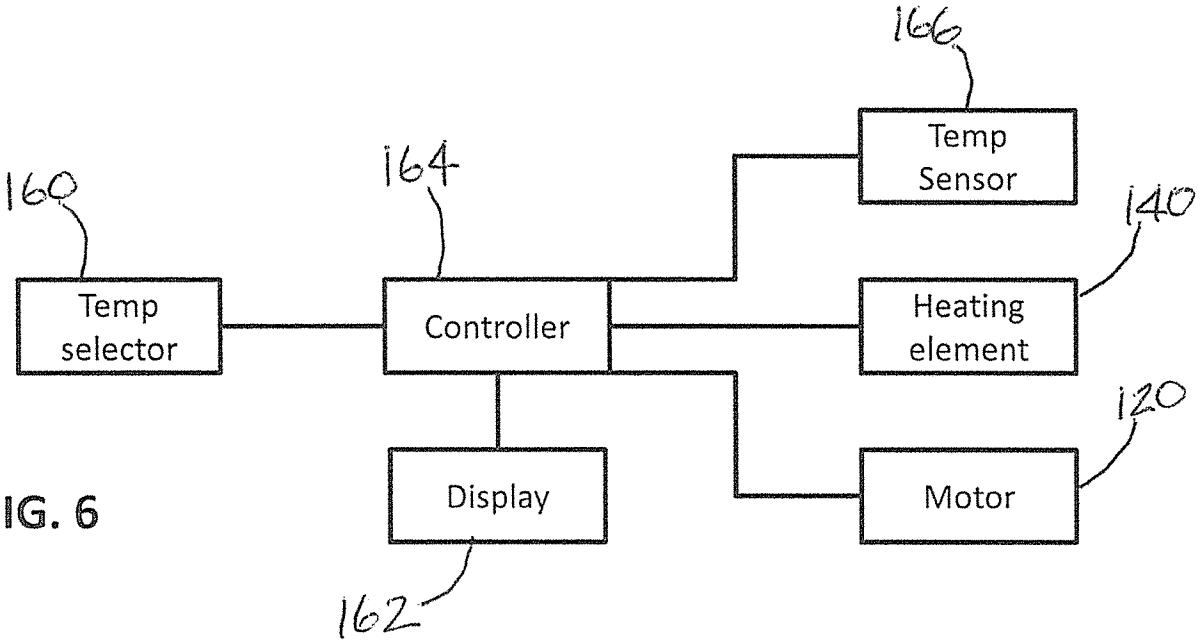
FIG. 6 illustrates an exemplary block diagram of a temperature control logic for controlling a pump in accordance to an embodiment of the present disclosure.

A block diagram for the temperature control electronics is shown in FIG. 6. The temperature selector 160 may be a simple potentiometer, or may be a more complicated panel having switches for both automatic and manual temperature control. The temperature selector 160 is connected to a controller 164. The controller 164 may be a simple combinational/sequential logic device or may be a more complicated microprocessor based circuit. The controller 164 receives input from the temperature selector 160 and the state of the motor 120 as to whether the motor has been activated or not. Based on these parameters, the controller 164 sends the appropriate electrical signals to the heating element 140 in order to control the temperature of the water. Temperature sensor 166 is disposed in the basin 12 and feeds actual water temperature back to the controller 164. The controller 164 is then capable of adjusting the electrical current to the heating element 140 to either maintain or change the temperature of the water. The controller 164 also sends information to the display 162 so that parameters such as selected water temperature and/or actual water temperature may be viewed. The controller 164 may also have an internal clock to display elapsed time that the jet pumps 100 have been activated for a particular customer.

Figure 7:
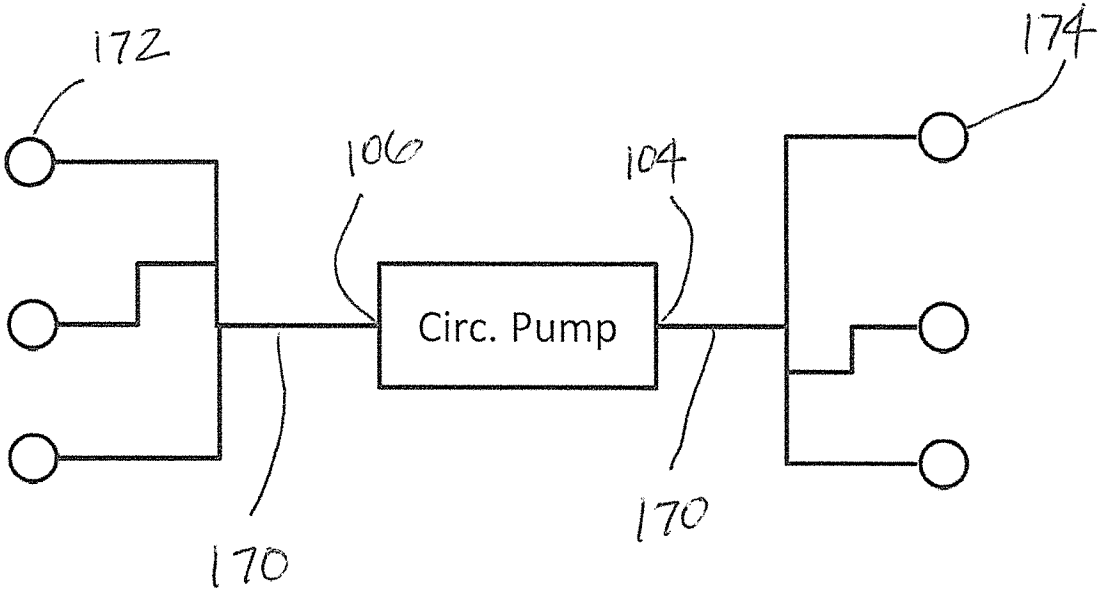
FIG. 7 illustrates a schematic diagram showing a connection scheme in accordance to one embodiment in which pipe is connected to a circulating pump.

A schematic diagram of an alternative embodiment is illustrated in FIG. 7. In this embodiment, routing pipe 170 is disposed within the chair or other apparatus for both intake port 106 access and outlet port 104 access. In applications where sanitation is not of primary concern, alternative intakes and outlets may have an application. One or more intake openings 172 may be routed to the intake port 106. Water (or other types of fluid) enters the intake openings 172 and is routed via the piping 170 to the intake port 106. Similarly, one or more of the outlet ports 104 may be coupled to piping 170 and routed to discharge heated water/fluid at various outlet openings 174.

In still other examples, the basin may have a pump associated with a heating element for heating water with the heating element and a pump not associated with any heating element. For example, if a single heating element is known to efficiently heat water within a desired set time to a set range, then a second heating element may not be needed or associated with a second circulating pump.

Although limited embodiments have been specifically described and illustrated herein, many modifications and variations will be apparent to those skilled in the art. Accordingly, it is to be understood that the apparatus constructed according to principles of the disclosed device, system, and method may be embodied other than as specifically described herein. The disclosure is also defined in the following claims.

What is claimed is:

1. A pump sized and shaped for use with a basin of a pedicure chair, comprising:

a motor having a motor housing;

a pump housing having an first housing element with a structure that is adjustable on an outer surface of a second housing element to vary a gap for locating a wall of a basin at the gap when mounting the pump to the basin, said second housing element having a base wall having a protruding shaft extending away from a surface of the base wall, and an inner cavity, said second housing element further having a first end located closer to the motor than a second end, said second end connected to a cover, and said cover comprising an inlet port and an outlet port and together with the second housing element defining a housing cavity;

a heat source disposed at least in part in the housing cavity and arranged to be adjacent both the inlet port and the outlet port such that water flowing into the inlet port passes through and is heated by the heat source before the water passes across an impeller; said heat source having arcuate heating sections defining an open space and gaps between the arcuate heating sections;

wherein the arcuate heating sections of the heat source define a spiral shaped coil comprising a continuous spiral shape and a portion radially crossing the spiral shape; and the impeller connected to the shaft and disposed in the housing cavity and, at least in part, within the open space of the heat source.

2. The pump of claim 1, wherein the heat source has a longitudinal coil section.

3. The pump of claim 1, wherein the heat source further comprises a terminus, wherein the terminus projects, at least in part, through the base wall comprising a shaft opening formed with the pump housing.

4. The pump of claim 3, further comprising a first set of electrical wires connected to the motor and a second set of electrical wires connected to the heat source.

5. The pump of claim 1, wherein the impeller circulates water within the inner cavity and around the heat source to produce heated water.

6. The pump of claim 1, further comprising a basin wall surface located at the gap.

7. The pump of claim 1, wherein the impeller is located axially evenly with an outer-most coil section of the spiral shaped coil.

8. The pump of claim 1, wherein the spiral shaped coil of the heat source has a hollow core.

9. The pump of claim 8, wherein the spiral shaped coil of the heat source comprises a plurality of coils made from a length of thin wall metal tubing rolled or coiled into a continuous loop having two or more coils axially positioned relative to one another.

10. The pump of claim 9, wherein a heating wire is positioned inside the length of tubing before the tubing is coiled.

11. The pump of claim 10, wherein a gap between the tubing and the heating wire comprises an insulator comprising magnesium oxide insulation (MGO).

12. The pump of claim 9, wherein the spiral shaped coil comprises a portion of tubing crossing the spiral shape.

13. A pedicure chair with water circulation comprising:

a basin comprising an exterior surface and an interior surface for holding water; and at least one pump coupled to the basin, the pump comprising:

a motor having a motor housing;

a pump housing having a base wall having a protruding shaft extending away from a surface of the base wall, an inner cavity, and a first end located closer to the motor than a second end of the pump housing;

a heat source disposed at least in part in the inner cavity of the pump housing and arranged to be in simultaneous fluid communication with water flowing into an inlet port and water flowing out of an outlet port of a cover; said heat source having a structure defining a continuous spiral shaped coil comprising a spiral shape and a portion radially crossing the spiral shape, the spiral shaped coil defining an open space on an inside of the continuous spiral coil;

an impeller connected to the shaft and disposed, at least in part, within the inner cavity of the pump housing and within the open space of the heat source; and the cover having a body connected to the second end of the pump housing, the body of the cover comprising the inlet port and the outlet port;

wherein the motor is disposed on the exterior surface of the basin and the cover is disposed on the interior surface of the basin.

14. The pedicure chair of claim 13, wherein the continuous spiral shaped coil comprises an outermost coil section closer to the cover than the base wall of the pump housing, said base wall comprising a shaft opening.

15. The pedicure chair of claim 13, wherein the heat source has a longitudinal coil section.

16. The pedicure chair of claim 13, wherein the heat source further comprises a terminus and wherein the terminus is offset from the open space and projects, at least in part, through the base wall on the pump housing.

17. The pedicure chair of claim 16, further comprising a first set of electrical wires connected to the motor and a second set of electrical wires connected to the heat source.

18. The pedicure chair of claim 13, wherein the impeller circulates water within the inner cavity and around the heat source to produce heated water.

19. The pedicure chair of claim 18, wherein the heated water is discharged from the pump via the outlet port.

20. The pedicure chair of claim 13, further comprising a temperature control system comprising a temperature selector and a controller, and wherein the controller is connected to the heat source.

21. The pedicure chair of claim 20, further wherein the temperature control system further comprises a display disposed on a chair for displaying water temperature in the basin.

22. The pump of claim 13, wherein the portion of the spiral shaped coil being nearest the inlet port and farthest from the base wall of the pump housing.

23. A method for circulating heated water in a basin of a pedicure chair, comprising:

attaching a pump comprising a motor and a pump housing to the basin having a basin interior and a basin exterior so that the pump housing is at least partly inside the basin interior and the motor is located externally of the basin exterior, the pump comprising a cover having a body comprising an inlet port and an outlet port attached to the pump housing and covering a chamber defined by the pump housing;

disposing an impeller and a heat source in the chamber such that water entering the inlet port and discharging out the outlet port simultaneously contact the heat source, the heat source having a structure defining a coil comprising a continuous spiral shape and a portion radially crossing the spiral shape;

providing electrical current to the heat source;

rotating the impeller to draw water from the basin into the chamber through the inlet port;

circulating the water in the chamber;

transferring heat from the heat source to the water;

discharging heated water from the chamber out the outlet port on the body of the cover to the basin; and wherein the heat source is in simultaneous fluid communication with water flowing into the inlet port and water flowing out of the outlet port of the cover and the portion crossing the spiral shape positioned between the inlet port and the impeller.

24. The method of claim 23, further comprising isolating the motor from the chamber such that water is prevented from entering the motor.

25. The method of claim 23, further comprising altering the electrical current to the heat source to change the temperature of the water in the basin.

26. The method of claim 23, further comprising circulating water between coils of the heat source to affect the heat transfer.

* * * * *